US005104520A

United States Patent [19]

Maronde et al.

[11] Patent Number: 5,104,520

[45] Date of Patent: Apr. 14, 1992

[54] APPARATUS AND METHOD FOR SEPARATING CONSTITUENTS

[75] Inventors: Carl P. Maronde, McMurray; Richard P. Killmeyer, Jr., Pittsburgh, both of Pa.

[73] Assignee: The United States of America as represented by the United States Department of Energy, Washington, D.C.

[21] Appl. No.: 542,604

[22] Filed: Jun. 25, 1990

[51] Int. Cl.[5] ..... B04C 3/00

[52] U.S. Cl. ..... 209/144; 209/159; 209/211; 210/512.3; 210/787

[58] Field of Search ..... 209/155, 158, 159, 208, 209/210, 211, 453, 144; 210/512.1, 512.3, 787, 788; 494/43

[56] References Cited

U.S. PATENT DOCUMENTS

| | | | |
|---|---|---|---|
| 2,769,546 | 11/1956 | Fontein | 209/211 X |
| 3,739,910 | 6/1973 | Wilson . | |
| 3,802,570 | 4/1974 | Dehne | 210/304 |
| 4,171,960 | 10/1979 | Jarvenpaa | 209/144 |
| 4,336,040 | 6/1982 | Haberl | 55/429 X |
| 4,365,741 | 12/1982 | Greer et al. | 209/453 X |
| 4,414,112 | 11/1983 | Simpson et al. | 209/211 X |
| 4,533,468 | 8/1985 | Ensor et al. | 210/512.3 X |
| 4,818,295 | 4/1989 | Converse et al. | 127/1 |
| 4,819,808 | 4/1989 | Andres et al. | 209/1 |

FOREIGN PATENT DOCUMENTS

| | | | |
|---|---|---|---|
| 417167 | 7/1974 | U.S.S.R. | 209/222 |
| 626810 | 8/1978 | U.S.S.R. | 210/512.1 |
| 893268 | 12/1981 | U.S.S.R. | 209/211 |
| 952350 | 8/1982 | U.S.S.R. | 209/211 |

OTHER PUBLICATIONS

Douglas N. Moir, "Sedimentation Centrifuges—What You Need To Know," Chemical Engineering, Mar. 28, 1988.

Intermagnetics General Corporation, equipment brochure on the Magnetohydrostatic Separator, (Fall, 1988).

Raymond E. Zimmerman, "The Japanese Swirl Cyclone," Preprint 77-F-17 1977 AIME Annual Meeting, Atlanta, Georgia, Mar. 6-10, 1977.

J. Abbott, K. W. Bateman and S. R. Shaw, "The Vorsyl Separator," National Coal Board.

P. J. F. Fourie, P. J. Van Der Walt, and L. M. Falcon, "The Beneficiation of Fine Coal by Dense-Medium Cyclone", Journal of the South African Inst. of Mining and Metallurgy, Oct. 1980, 357-361.

*Primary Examiner*—Donald T. Hajec
*Assistant Examiner*—Joseph A. Kaufman
*Attorney, Agent, or Firm*—Hugh W. Glenn; Robert J. Fisher; William R. Moser

[57] ABSTRACT

A centrifugal separator apparatus and method for improving the efficiency of the separation of constituents in a fluid stream. A cyclone separator includes an assembly for separately discharging both constituents through the same end of the separator housing. A rotary separator includes a rotary housing having a baffle disposed therein for minimizing the differential rotational velocities of the constituents in the housing, thereby decreasing turbulence, and increasing efficiency. The intensity of the centrifugal force and the time which the constituents reside within the housing can be independently controlled to improve efficiency of separation.

12 Claims, 4 Drawing Sheets

APPARATUS AND METHOD FOR SEPARATING CONSTITUENTS

CONTRACTUAL ORIGIN OF THE INVENTION

The U.S. Government has rights in this invention pursuant to the employer-employee relationship of the Government to the inventors, employees of the U.S. Department of Energy and the Pittsburgh Energy Technology Center.

BACKGROUND OF THE INVENTION

The present invention is directed to an apparatus and method for separating constituents and, more particularly, to an apparatus and method for separating constituents in a fluid stream on the basis of differences in density or mass of the constituents by the use of centrifugal force.

Devices for separating constituents by centrifugal force on the basis of differences in density or mass of the constituents are well known in the art. The fluid stream is typically comprised of a liquid separating fluid and two or more constituents to be separated. The constituents typically comprise solids or liquids having different densities or mass.

Typically, the separation is accomplished in a cyclone separator such as the one disclosed in U.S. Pat. No. 3,802,570 to Dehne. As disclosed therein, the constituents to be separated which are intermixed in a fluid stream are fed under pressure through an inlet duct and into the interior of a stationary housing to cause the formation of a vortex in the housing. The vortex, in turn, causes the creation of a centrifugal force which causes the constituents of a lower density or mass to migrate towards the longitudinal axis of the housing and the constituent of a higher density or mass to migrate towards the inner surface of the housing. The constituent of lower density or mass is discharged through one end of the cyclone while the constituent of a higher density or mass is discharged through the opposite end of the cyclone.

The two-directional flow of the constituents in the housing resulting from the discharge of the constituents through opposite ends of the cyclone is disadvantageous because it increases the congestion of the constituents in the area of the housing where the direction of the flow of the constituents separates into an upward flow towards one end of the cyclone and a downward flow towards the opposite end of the cyclone. As a result, there is increased contact among the constituents of the fluid stream. Also, the fluid turbulence within the cyclone adds to the mixing of the constituents. In turn, it is believed that constituent interaction and increases in turbulence correlate to a decrease in efficiency of constituent separation.

Further, cyclone separators become inefficient when constituents comprising very fine particles (i.e., of less than 100 microns) are separated. Attempts to improve the efficiency of separation by only increasing the intensity of the centrifugal force (i.e., by increasing the velocity of the fluid stream being fed into the housing), disadvantageously diminishes the time which the constituents reside within the housing since the residence time is inversely proportional to the velocity of the fluid stream. Further, turbulence within the housing is disadvantageously increased due to the increased velocity of the fluid stream through an inlet duct whose size is not varied in response to the increase in fluid flow there-through. Also, attempts to increase centrifugal force while maintaining residence times, via reducing the size of the inlet duct while keeping volumetric flow constant, disadvantageously increases turbulence. Therefore, the efficiency of separation is actually decreased when the centrifugal force is increased due to the reduction in residence time and increase in turbulence.

Alternatively, separation of constituents has, in the past, been accomplished in a rotary separator including a rotating housing rather than a stationary housing as disclosed in the above-identified cylone separator. In the rotary separator, the fluid stream is gravity fed into the rotating housing. Thereafter, the stream is forced into a circular flow pattern by the friction of the stream against the inner surface of the rotating housing. The centrifugal force which develops within the housing, as a result of the circular force of the constituents, causes the constituents to separate in a manner similar to that described with respect to the cyclone separator. However, and unlike a cyclone separator, the constituents which have been separated are, typically, discharged through the same end of the separator.

As with the cyclone separator, when one attempts to improve the efficiency of separation by increasing the intensity of the centrifugal force (i.e., by increasing the rate of rotation of the housing), the residence time of the constituents within the housing may be disadvantageously decreased thereby contributing to a reduction in the efficiency of separation.

In rotary separators, the efficiency of separation is additionally adversely affected (i.e., reduced) by the differential rotational velocities that are present across a given radial section of the interior of the housing due to the high centrifugal force action on the fluid stream. The differential rotational velocities contribute to increased turbulence within the housing which, in turn, has a disadvantageous effect on the efficiency of separation.

SUMMARY OF THE INVENTION

It is a general object of the invention to provide an improved apparatus and method for separating constituents which avoids the disadvantages of prior apparatuses and methods while affording additional structural and operating advantages.

Another object of the invention is the provision of a separator apparatus and method for the independent control of the intensity of the centrifugal force and the residence time of the fluid stream in the separator housing without increasing turbulence thereby increasing the efficiency of separation.

Yet another object of the invention is the provision of a cyclone separator wherein constituent-to-constituent congestion and interference occurring as a result of the two-directional flow of the constituents in opposite directions is avoided, thereby contributing to a reduction in turbulence and, therefore, an increase in the efficiency of separation.

A further object of the invention is the provision of a rotary separator wherein differential rotational velocities of the constituents within the housing are minimized, thereby minimizing turbulence and, therefore, increasing the efficiency of constituent separation.

These and other objects of the invention are attained by providing an apparatus for separating first and second constituents from a fluid stream including a first lower density or mass constituent and a second higher density or mass constituent, the apparatus comprising a stationary hollow cylindrical housing defining a longitudinal axis and having an inlet opening at one end and an outlet opening at the other end, inlet means for introducing the fluid stream under pressure to form a vortex in the housing, the vortex producing a centrifugal force causing the first constituent to migrate radially inwardly towards the longitudinal axis of the housing and the second constituent to migrate radially outwardly towards the housing, and outlet means in fluid communication with the outlet opening for separately discharging the first and second constituents.

Additionally, there is provided an apparatus for separating constituents from a flowing stream including a first lower density or mass constituent and a second higher density or mass constituent, the apparatus comprising a rotating cylindrical housing defining a longitudinal axis and having an inlet opening at one end and an outlet opening at the other end, means for introducing the fluid stream into the housing, means for rotating the housing to cause the rotation of the stream within the housing, the rotation of the stream producing a centrifugal force causing the first constituent to migrate radially inwardly towards the longitudinal axis of the housing and the second constituent to migrate radially outwardly towards the housing, an elongated baffle in the housing for reducing the turbulence of the fluid stream, the baffle extending radially through the longitudinal axis of the housing and dividing the housing into a plurality of compartments, and outlet means in fluid communication with the outlet opening for separately discharging the first and second constituents.

Further, there is provided a method of separating first and second constituents from a fluid stream including a first lower density or mass constituent and a second higher density or mass constituent, the method comprising the steps of introducing the stream into a cylindrical housing, the housing defining a longitudinal axis and having an inlet opening at one end and an outlet opening at the other end, rotating the housing to cause the rotation of the fluid stream in the housing, the rotation of the fluid stream producing a centrifugal force causing the first constituent to migrate radially inwardly towards the longitudinal axis of the housing and the second constituent to migrate radially outwardly towards the housing, varying the intensity of the centrifugal force, discharging the first and second constituents separately through the outlet opening, and varying the rate of the fluid stream flowing through the inlet opening and the rate of the first and second constituents flowing through the outlet opening to control the time which the stream resides within the housing.

The invention consists of certain novel features and a combination of parts hereinafter fully described, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings preferred embodiments thereof, from an inspection of which, when considered in connection with the following description, the invention, its construction and operation, and many of its advantages should be readily understood and appreciated.

DESCRIPTION OF THE DETAILED EMBODIMENTS

Figure 1:
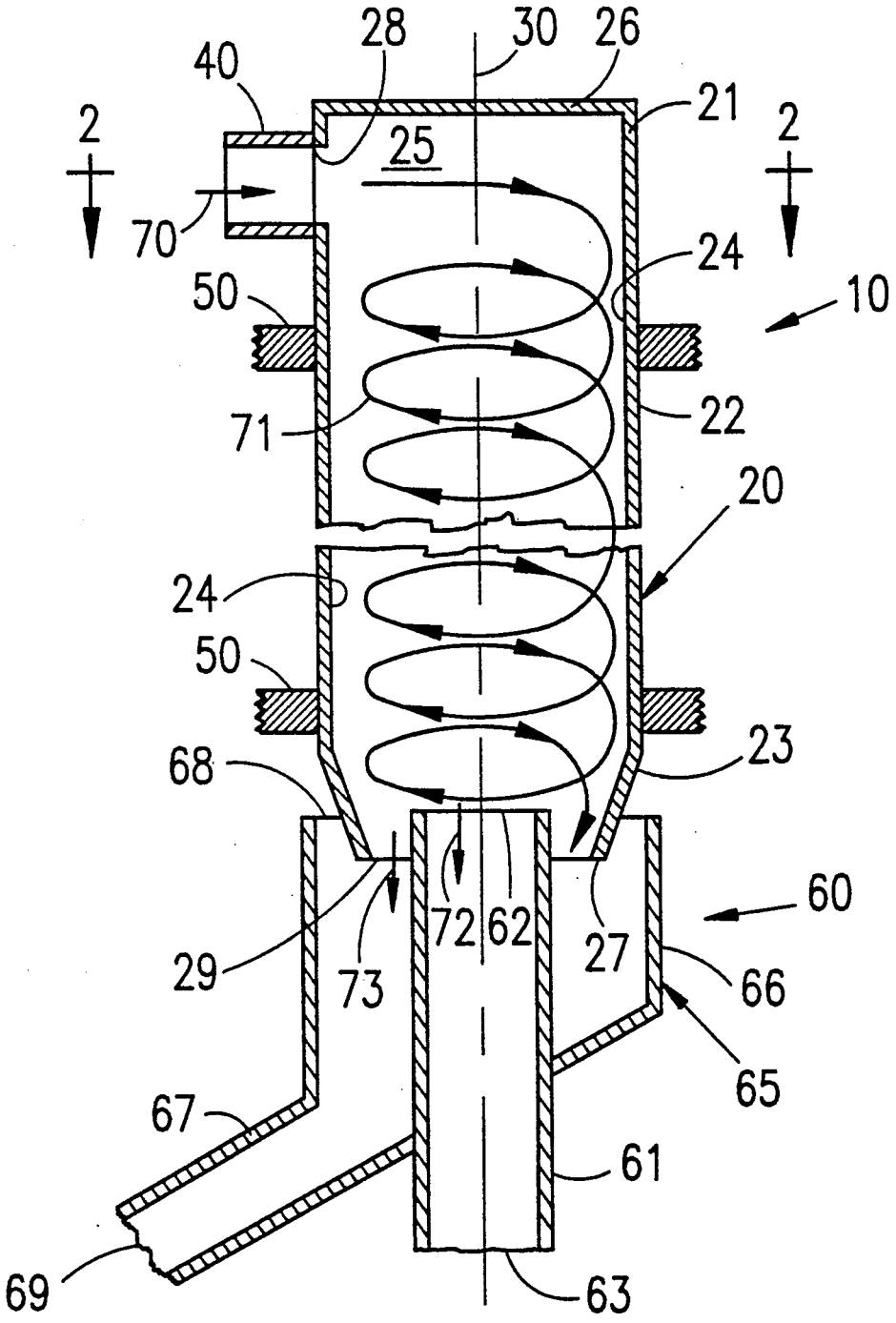
FIG. 1 is a longitudinal, cross-sectional view of a cyclone separator apparatus incorporating the features of the present invention.
Figure 2:
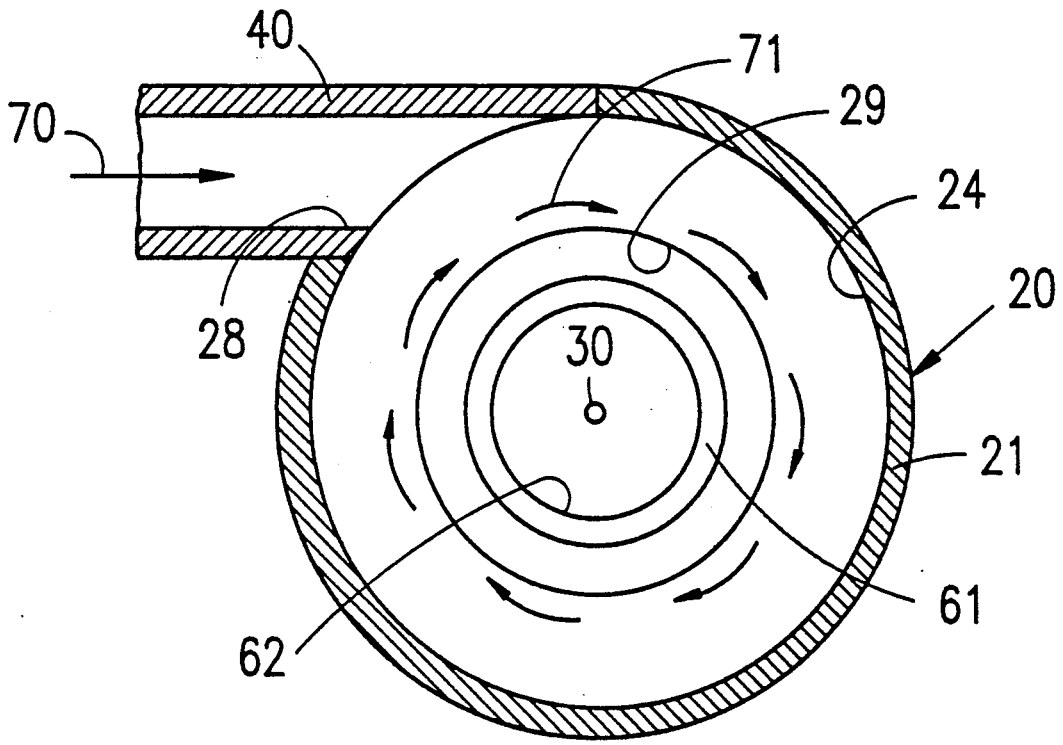
FIG. 2 is an enlarged cross-sectional view taken along line 2—2 of FIG. 1.

Referring to FIGS. 1 and 2, there is illustrated an apparatus for separating constituents contained in a fluid stream, in the embodiment of a cyclone separator 10.

The separator 10 comprises a housing 20 including a wall 21 having an elongated cylindrical portion 22 and a frusto-conical portion 23 extending from the cylindrical portion 22. The wall 21 has an inner surface 24 defining a hollow interior 25 having a longitudinal axis 30. The housing 20 further includes a top 26 and an outlet end 27. An inlet opening 28 is formed in the wall 21 adjacent the top 26. A cylindrical outlet opening 29 is formed at the outlet end 27.

The separator 10 additionally includes an inlet duct 40 in communication with the opening 28 and tangentially connected to the wall 21, see FIG. 2. The separator 10 further comprises a structure 50 on the outer surface of the wall 21 for rigging and securing the housing 20 to a stationary support structure (not shown).

The separator 10 includes a discharge assembly 60 having an elongated cylindrical recovery pipe 61 with an inlet opening 62 and an outlet opening 63. The assembly 60 further includes a recovery sluice 65 having a cylindrical portion 66 coaxial with the pipe 61 and the housing 20 and an angled cylindrical portion 67 extending from the portion 66. The sluice 65 has an inlet opening 68 at one end of the portion 66 and an outlet opening 69 at the end of the portion 67.

The recovery pipe 61 has a diameter less than the diameter of the outlet opening 29 of the housing 20 and is disposed coaxially with the outlet end 27 of the housing 20 such that a portion of the member 61 is disposed within the outlet opening 29. The recovery pipe 61 is adjustable and replaceable with other pipes of different diameters for various applications. The sluice 65 surrounds the outlet opening 29 and is disposed adjacent the outlet end 27 such that a portion of the frusto-conical portion 23 of the housing 20 is disposed within the inlet opening 68.

According to the invention, a fluid stream including a first lower density or mass constituent and a second higher density or mass constituent under pressure, via gravity or pumping, through the duct 40 in the direction of arrow 70. It is understood that the separator 10 is intended for use in separations wherein the two distinct constituents comprise liquid/liquid, liquid/solid, and solid/solid constituents. With regard to the separation of solids based on constituent density, the invention is most suitable with the use of a liquid separating fluid medium with an appropriate density higher than water such as an acid, an organic liquid, or a brine or sugar solution. Fluids consisting of a suspension of particles in a carrier liquid, such as finely ground magnetite in water, may also be used for the separation of solid constituents.

The tangential entry of the fluid stream into the interior 25 converts the linear fluid stream flow into a downwardly spiraling, rotating vortex 71. The vortex 71 rotates in a generally helical path about the longitudinal axis 30 of the housing 20. The swirling action of the vortex 71 causes the creation of a centrifugal force which causes the constituent having a lower density or mass to migrate radially inwardly towards the longitudinal axis 30 of the housing 20 and the constituent having a higher density or mass to migrate radially outwardly towards the inner surface 24 of the wall 21.

The constituent which migrates towards the longitudinal axis 30 is discharged in the direction of arrow 72 through the inlet opening 62 into the pipe 61 and is recovered through the outlet opening 63. In a like manner, the constituent which migrates towards the inner surface 24 of the wall 21 is discharged through the outlet opening 29 in the direction of arrow 73 and into the inlet opening 68 of the sluice 65 and is recovered at the outlet opening 69.

The separate discharge of both constituents through the same end of the separator 10, i.e., through the outlet end 27 of the housing 20, eliminates the two-directional flow of constituents in presently available cyclones wherein the constituents are discharged through opposite ends. The unidirectional flow of the constituents caused by the discharge of both constituents through the same end greatly reduces the constituent-to-constituent congestion and interference resulting from two-directional flow of constituents in the housing. As a result of the unidirectional flow of both constituents, turbulence is minimized and it is believed that a reduction in turbulence correlates to a corresponding increase in the efficency of separation.

Figure 3:
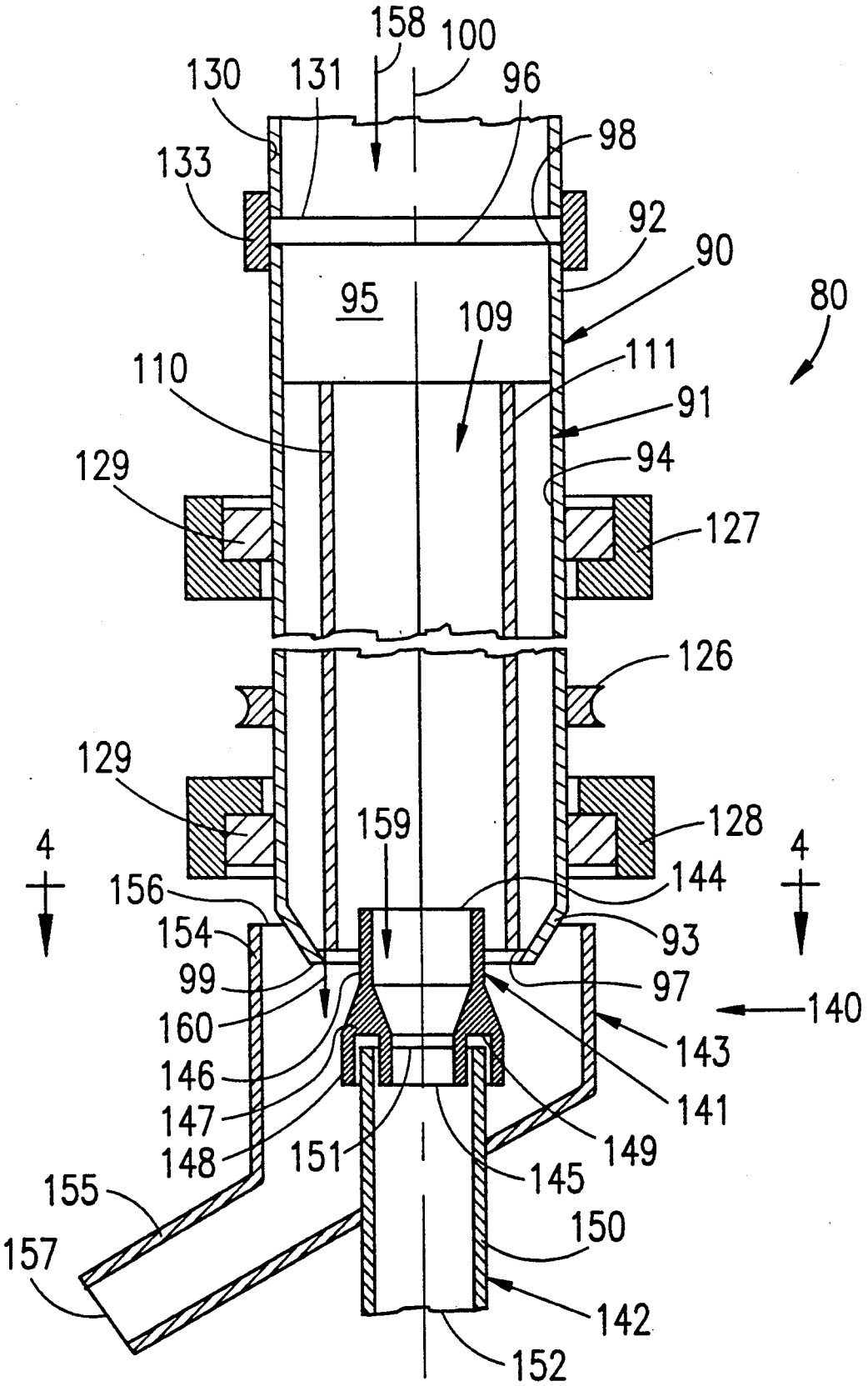
FIG. 3 is a longitudinal, cross-sectional view of an alternate embodiment of a separator apparatus incorporating the features of the present invention.
Figure 4:
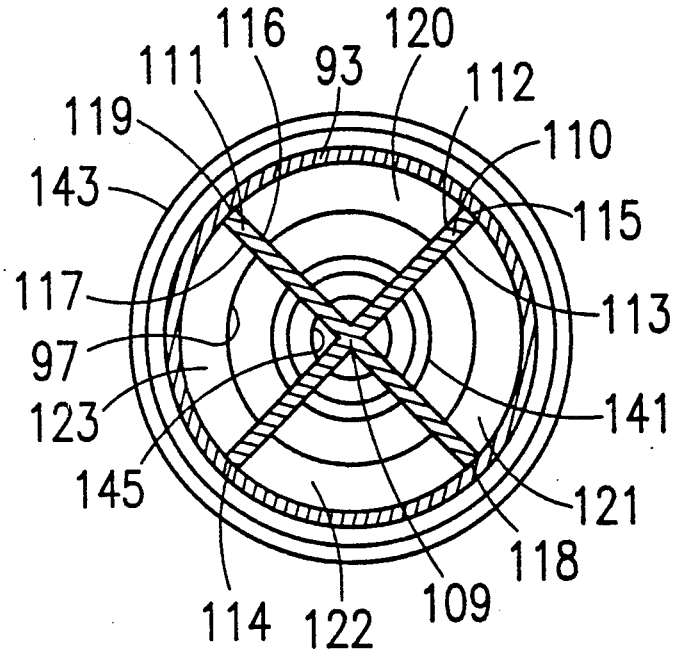
FIG. 4 is an enlarged cross-sectional view taken generally along line 4—4 of FIG. 3.

An alternate embodiment of the invention is a rotary separator 80, as depicted in FIGS. 3 and 4. The rotary separator 80 comprises a rotatable housing 90 including a wall 91 having a cylindrical portion 92 and a frusto-conical portion 93 extending therefrom. The wall 91 has an inner surface 94 defining an interior 95 having a longitudinal axis 100. Further, inlet and outlet openings 96 and 97 are formed at opposite ends 98 and 99 respectively of the separator 80.

The separator 80 has an internal baffle 109 disposed in the interior 95 of the housing 90. As shown in FIG. 4, the baffle 109 is cruciform in cross-section and segments the interior 95 into four pie-shaped compartments 120–123. As further shown in FIG. 4, the baffle 109 is comprised of two sheets or plates 110 and 111 which intersect along the longitudinal axis 100 of the housing 90. The plate 110 has opposed surfaces 112 and 113 and opposed ends 114 and 115 while the plate 111 has opposed surfaces 116 and 117 and opposed ends 118 and 119. As shown in FIG. 3, the plates 110 and 111 extend longitudinally from adjacent the inlet end 96 of the housing 90 to adjacent the outlet end 97 of the housing 90. As shown in FIG. 4, the plates 110 and 111 are disposed perpendicularly to each other and extend radially through the longitudinal axis 100 and between opposite sides of the inner surface 94 such that opposite ends 114 and 115 of the plate 110 and opposed ends 118 and 119 of the plate 111 engage opposed sides of the inner surface 94.

Although the housing 90 as depicted in FIGS. 3 and 4 includes a baffle 109 having two plates 110 and 111 forming four compartments, it is understood that the present invention is likewise applicable to a housing 90 having a baffle 109 having one plate segmenting the interior 95 into two compartments, or a housing 90 including a baffle 109 having greater than two plates segmenting the interior 95 into greater than four compartments.

The separator 80 further comprises a rotating mechanism including a drive pulley 126 which is connected to the outer surface of the wall 91. The drive pulley 126 is coupled to a prime mover (not shown) by a belt (not shown) to provide for the rotation of the housing 90. Bearing assemblies 127 and 128 allow for the smooth rotation of the housing 90 and the confinement of the housing 90 in both the radial and axial directions. The housing 90 is rotatable along its longitudinal axis 100 at a rate up to several thousand rpms. The separator 80 further comprises a structure 129 on the outer surface of the wall 91 for rigging and securing the housing 90 to the bearing assemblies 127 and 128.

The separator 80 further comprises a jigging mechanism 129 for vibrating the housing 90.

The separator 80 has an inlet duct 130 axially aligned with the housing 90 and having an inlet opening 131 coupled to the inlet end 98 of the housing 90 by means of a seal 133. Although the inlet duct 130 is depicted as having a diameter equal to the diameter of the housing 90, it is understood that the duct 130 may be configured such that its diameter is less than the diameter of the housing 90. The separator 80 additionally comprises a discharge assembly 140 having a circular splitter 141, a pipe 142, and a sluice 143.

The splitter 141 has an inlet 144 at one end and an outlet 145 at an opposite end. The splitter 141 is a cylindrical tube connected to an coaxially aligned at the housing 90 and is positioned at the end 99 of the housing with a portion 146 extending into the housing 90 and a portion 147 extending exterior of the housing. The portion 147 terminates in an annular clevis 148 forming an annulus 149 therebetween. Since the splitter 141 is connected to the housing 90, it is rotatable therewith.

The discharge pipe 142 is a cylindrical pipe coaxially aligned with the housing 90 an having an inlet 151 and an outlet 152. The inlet 151 of the pipe 142 is disposed within the annulus 149 of the splitter 141. Since the pipe 142 is not connected to the splitter 141, it is not rotatable therewith.

The sluice 143 has a cylindrical portion 154 coaxial with the pipe 142 and the housing 90 and an angled cylindrical portion 155 extending from the portion 154. The sluice 143 has an inlet opening 156 at one end of the portion 154 and an outlet 157 at the end of the portion 155. The sluice 143 surrounds the outlet opening 99 of the housing 90 and is disposed adjacent the outlet end 97 such that a portion of the frusto-conical portion 93 is disposed within the inlet 156.

According to the invention, a fluid stream, similar to the fluid stream described with respect to the separator 10 depicted in FIGS. 1 and 2, is introduced into the housing 90 through the inlet duct 130 in the direction of arrow 158. The fluid stream may be pressure fed as described earlier with respect to the cyclone of FIG. 1 or, more typically, gravity fed into the inlet duct 130.

After the stream enters the housing 90, it is forced into a circular flow pattern by the friction of the stream against the inner surface 94 of the wall 91. The rotation of the stream produces a centrifugal force which causes the constituent having a lower density or mass to migrate radially inwardly towards the longitudinal axis 100 of the housing 90 and against the opposing surfaces 112–113 and 116–117 of the plates 110 and 111. The constituent having a higher density or mass migrates radially outwardly towards the inner surface 94 of the wall 91.

The lower density constituent which has migrated towards the longitudinal axis 100 is discharged in the direction of arrow 159 through the inlet 144 of the splitter 141 and through the discharge pipe 142, while the higher density or mass constituent which has migrated towards the inner surface 94 of the housing 90 is discharged through the outlet opening 99 in the direction of arrow 160 and then through the sluice 143.

According to the invention, the splitter 141 can be replaced with other splitters having openings 144 of different diameters to allow variance in the ratio or proportion of the lower density constituent and higher density constituent being discharged through the splitter 141 and the sluice 143, respectively. By increasing the diameter of the opening 144, it is understood that an increased amount of the higher density constituent will be discharged through the splitter 141 rather than through the sluice 143. In a like manner, as the diameter of the opening 144 is decreased, it is understood that an increased amount of the lower density constituent will be discharged through the sluice 143 rather than through the splitter 141.

As a result of being able to vary the diameter of the opening 144, the quality (i.e., in terms of relative density or mass) and the quantity of the constituents being discharged through the splitter 141 and the sluice 143 can be advantageously varied to meet diverse constituent quality specifications for various applications.

According to the invention, the baffle 109 is configured and arranged to minimize the differential rotational velocities of the constituents within the housing, thereby minimizing turbulence and, therefore, increasing the efficiency of constituent separation. In an unbaffled separator, the rotation of the housing causes the rotational movement of the constituents within the fluid stream at a given velocity. Further, the centrifugal force which causes the constituents to separate radially in opposite directions causes a radial movement of the constituents within the fluid stream at a given velocity. Since the constituents are moving or travelling rotationally, radially and axially (i.e., from the inlet duct 130 to the outlet) within the housing, excessive turbulence may exist which along with constituent-constituent interaction disadvantageously decreases separation efficiency.

In the present invention, the rotational velocity of the constituents is minimized by separating the interior 95 into a plurality of compartments. As a result, the motion of the constituents within each of the compartments is comprised primarily of motion in a radial direction either towards the longitudinal axis 100 or towards the inner surface 94 of the housing 90, and in an axial direction towards the outlet opening 99. Absent the rotational velocity of the constituents within the compartments, turbulence is decreased and efficiency is increased.

According to the invention, the intensity of the centrifugal force created by the rotation of the housing 90 and the time which the stream resides within the housing 90 can be independently controlled to maximize the efficiency of constituent separation. As noted earlier, a disadvantage of present separators is that the intensity of the centrifugal force cannot be increased without adversely decreasing the residence time of the stream or significantly increasing turbulence within the separator housing.

The intensity of the centrifugal force can be varied by varying the rate of rotation of the housing 90. An increase in the intensity of the centrifugal force is advantageous because it increases the efficiency of the separation of even a constituent having the finest particles (i.e., less than 100 microns). However, in present separators, an increase in the intensity of the centrifugal force typically correlates into a decrease in the time which the stream resides within the housing. In the present invention, a decrease in residence time is avoided by varying the rate of the stream flowing through the inlet opening 96 and the rate of the stream flowing through the outlet opening 97. The rate of the stream flowing through the inlet opening 96 is controlled by varying either the size of the opening 131 of the inlet duct 130 or the pressure at which the fluid stream is introduced. On the other hand, the rate of the stream flowing through the outlet opening 97 is controlled by varying the size of the outlet opening 97. In any application, the outlet 97 must be of such a size as to provide for the complete back filling of the separator with the constituents and medium to ensure that the constituents do not free fall through the device and thereby avoid separation.

By varying the rate of the stream flowing through the inlet and outlet openings 131 and 97, respectively, residence times as long as hours can be achieved with the separator almost acting in a batch mode. The exact length of the residence time required will be dependent in each application upon how small the outlet opening 97 is made with respect to either the size of the inlet opening 131 or the pressure at which the fluid stream is introduced into the housing 90. For example, a long residence time can be acquired if the outlet opening 97 is made much smaller than the inlet opening 131. Additionally, a long residence time can be acquired if the outlet opening 97 is made smaller than the inlet opening 96 and the fluid stream is pressure fed instead of gravity into the housing.

As a result of being able to independently control centrifugal force intensity and residence time without increasing turbulence, it is believed that efficiency of separation is increased.

What has been described therefore is an improved separator apparatus and method for separating constituents.

The embodiments and the method of the invention in which an exclusive property or privilege is claimed are defined as follows:

1. An apparatus for separating constituents from a fluid stream including a first lower density or mass constituent and a second higher density or mass constituent, said apparatus comprising: a rotating cylidrical housing, said housing defining a longitudinal axis and having an inlet opening at one end and an outlet opening at the other end, means for introducing said flowing stream into said housing, means for rotating said housing to cause the rotation of the flowing stream within said housing and producing a centrigugal force causing the first constituent to migrate radially inwardly towards the longitudinal axis of said housing and axially downwardly towards and through said outlet opening and the second constituent to migrate radially outwardly towards said housing and axially downwardly towards and through said outlet opening simultaneously with the first constituent, an elongated baffle in said housing for reducing the turbulence of the flowing stream, said baffle extending radially through the longitudinal axis of said housing and dividing said into a plurality of compartments, and outlet means in communication with said outlet opening for separately discharging the first and second constituents.

2. The apparatus of claim 1, wherein said baffle includes two plates intersecting along the longitudinal axis of said housing, said baffle dividing said housing into four compartments.

3. The apparatus of claim 2, wherein said plates intersect perpendicularly to each other such that said baffle is cruciform in cross-section.

4. The apparatus of claim 2, wherein each of said plates extend radially between opposite sides of said housing.

5. The apparatus of claim 1, wherein said baffle includes a plate extending radially between opposite sides of said housing and dividing said housing into two compartments.

6. The apparatus of claim 1, wherein said baffle includes a plurality of plates intersecting along the longitudinal axis of said housing and dividing said housing into a plurality of compartments.

7. An apparatus for separating constituents from a fluid stream including a first lower density or mass constituent and a second higher density or mass constituent, said apparatus comprising: a rotating cylindrical housing, said housing defining a longitudinal axis and having an inlet opening at one end and an outlet opening at the other end, means for introducing said flowing stream into said housing, means for rotating said housing to cause the rotation of the flowing stream within said housing, the rotation of the stream producing a centrifugal force causing the first constituent to migrate radially inwardly towards the longitudinal axis of said housing and the second constituent to migrate radially outwardly towards said housing, an elongated baffle in said housing for reducing the turbulence of the flowing stream, said baffle extending radially through the longitudinal axis of said housing and dividing said housing into a plurality of compartments, outlet means in fluid communication with said outlet opening for separately discharging the first and second constituents, and a splitter attached to said housing at said outlet end and rotatable therewith, said outlet means comprising a first member cooperating with said splitter, and a second member, the first constituent being discharged through said splitter and said first member and the second constituent being discharged through said second member.

8. An apparatus for separating constituents from a fluid stream including a first lower density or mass constituent and a second higher density or mass constituent, said apparatus comprising: a rotating cylindrical housing, said housing defining a longitudinal axis and having an inlet opening at one end and an outlet opening at the other end, means for introducing said flowing stream into said housing, means for rotating said housing to cause the rotation of the flowing stream within said housing, the rotation of the stream producing a centrifugal force causing the first constituent to migrate radially inwardly towards the longitudinal axis of said housing and a second constituent to migrate radially outwardly towards said housing, an elongated baffle in said housing for reducing the turbulence of the flowing stream, said baffle extending radially through the longitudinal axis of said housing and dividing said housing into a plurality of compartments, outlet means in fluid communication with said outlet opening for separately discharging the first and second constituents, and a splitter attached to said housing and said outlet end and rotatable therewith, said outlet means comprising a first member cooperating with said splitter, and a second member, the first constituent being discharged through said splitter and said first member and a second constituent being discharged through said second member, said first member being an elongated pipe, said splitter and said pipe being co-axial with said housing, and said second member being a sluice co-axial with and surrounding said outlet opening of said housing.

9. A method of separating first and second constituents from a fluid stream including a first lower density or mass constituent and a second higher density or mass constituent, said method comprising the steps of: introducing the flowing stream into a cylindrical housing, said housing defining a longitudinal axis and having an inlet opening at one end and an outlet opening at the other end, rotating said housing to cause the rotation of the flowing stream in said housing, the rotation of the flowing stream producing a centrifugal force causing the first constituent to migrate radially inwardly towards the longitudinal axis of said housing and the second constituent to migrate radially outwardly towards said housing, varying the intensity of the centrifugal force, discharging the first and second constituents separately and simultaneously through said outlet opening, and varying the rate of the flowing stream flowing through said inlet opening and the rate of the first and second constituents flowing through said outlet opening to control the time which the flowing stream resides within said housing.

10. The method of claim 9, including feeding the flowing stream through said inlet opening under pressure, and the rate of the fluid stream flowing through said inlet opening is controlled by varying the pressure thereof.

11. The method of claim 9, further comprising the step of feeding the fluid stream through an inlet duct connected to said inlet end of said housing and in cooperation with said inlet opening before feeding the fluid stream through said inlet opening, the rate of the fluid stream being fed through said inlet opening being controlled by varying the size of said inlet duct.

12. The method of claim 9, including varying the rate of rotation of said housing to control the centrifugal force.

* * * * *